United States Patent [19]

Chancellor

[11] Patent Number: 4,819,711

[45] Date of Patent: Apr. 11, 1989

[54] COMPACTABILITY AND PERMEABILITY CONTROL FOR FABRICATING ECP MOLD

[75] Inventor: Richard Chancellor, Dearborn, Mich.

[73] Assignee: Ford Motor Company, Dearborn, Mich.

[21] Appl. No.: 251,275

[22] Filed: Sep. 30, 1988

[51] Int. Cl.[4] ..... B22D 46/00

[52] U.S. Cl. ..... 164/456; 164/34

[58] Field of Search ..... 164/4.1, 456, 34, 35, 164/36, 39, 150, 154

[56] References Cited

U.S. PATENT DOCUMENTS

| | | | |
|---|---|---|---|
| 2,679,317 | 5/1954 | Roop | 209/560 |
| 2,890,347 | 6/1959 | McCormick | 378/56 |
| 3,136,010 | 6/1964 | Dietert et al. | 73/73 |
| 3,460,030 | 8/1969 | Brunton et al. | 324/58.5 A |
| 3,534,260 | 10/1970 | Walker | 324/58.5 A |
| 3,600,574 | 5/1971 | Glaza et al. | 250/375 |
| 3,608,357 | 9/1971 | Meunier | 73/38 |
| 3,638,478 | 2/1972 | Dietert et al. | 73/73 |
| 3,693,079 | 9/1972 | Walker | 378/53 |
| 4,555,934 | 12/1985 | Freeman et al. | 73/38 |
| 4,671,100 | 6/1987 | Doussiet | 73/38 |

FOREIGN PATENT DOCUMENTS

| | | | |
|---|---|---|---|
| 55-109564 | 8/1980 | Japan | 164/4.1 |

*Primary Examiner*—Richard K. Seidel

*Attorney, Agent, or Firm*—Joseph W. Malleck; Roger L. May

[57] ABSTRACT

A method of controlling, during the act of mold fabrication in real time, the compactability and permeability of a sand mold containing an evaporative foam pattern, comprising: (a) while agitating a supply of loose, unbonded sand introduced about such pattern suspended in a flask, supplying a pressurized gas to one station of the sand while permitting the gas to exit from another station of such sand supply; and (b) proportionally measuring the pressure differential between such stations thereby tendering a proportional indicator of sand compaction. Agitation is preferably carried out in stages, the first stage of which comprises agitation by vibration at a rate to migrate the loose sand grains into the interior voids of the pattern, and a second stage in which the vibration is carried out at a rate until the relationship $P_2=kP_1$ is satisified, where $P_1$ is supply pressure, $P_2$ is back pressure where the gas pressure attempts to migrate through the sand, and where k is a factor dependent on sand chemistry, shape, and moisture and is always less than one.

11 Claims, 6 Drawing Sheets

$P_2 = KP_1$, $K < 1.0$ $K$ = Function Of Sand Composition

COMPACTABILITY AND PERMEABILITY CONTROL FOR FABRICATING ECP MOLD

BACKGROUND OF THE INVENTION

1. Technical Field

This invention relates to the evaporative casting process (ECP), and to the art of measuring permeability and compactability of sand molds.

2. Description of the Prior Art

In ECP, a form or pattern of the item to be cast is made, as shown in FIG. 1. An evaporative pattern is advantageous because it produces an exact duplicate of the desired casting, preferably in expanded bead polystyrene. Complex patterns are usually made in sections to facilitate defining internal passages and contouring; such sections are then glued together to produce a completed pattern. Several of the patterns may be glued to a common sprue of a gating system to produce a cluster. Such cluster of patterns is coated with a refractory wash which acts as a thermal barrier between the molten metal and the unbonded sand mold to prevent sand burn-in and heat loss of the molten metal. The wash usually contains a finely ground refractory material, such as aluminum, zirconium, or silica flour, which is emulsified and suspended in a carrying agent such as water or alcohol.

The washcoated cluster is then placed in an oven to dry; after drying, it is set into a flask which is filled with free-flowing sand. The flask is essentially a pouring box which will contain loose molding material; such pouring box is either open-ended at its top and/or perforated at its sides to permit the migration of gases during and after the pouring of molten metal. The molding sand is unbonderized and free-flowing to permit the compaction of such sand around the delicate foam pattern after it is suspended in the flask and not before. The unbonded sand can be agitated either by aeration, using air or other gas, or the flask itself may be vibrated, both methods being effective to reduce the angle of repose of the sand as close as possible to zero, thus allowing the sand to flow into and fill all areas, including the inner and outer cavities of the pattern. Angle of repose means the angle of a cone formed by pouring the dry, unbonded sand medium onto a flat surface. The lower the angle, the closer the material to a liquid, which essentially takes the shape of the container into which it is poured. It is important that the sand be compacted or densified to provide support for the weight of the liquid metal to be poured into the flask and which displaces the foam pattern.

Molten metal is poured into the flask directly into the foam sprue or leader with the result that molten metal will evaporate the pattern progressively and displace it, as shown in FIG. 2. The formation of gases due to the evaporation of the foam pattern allows the unbonded molding material to remain in position. After the liquid metal has solidified, the casting and sand are dumped out of the flask and the casting is then sent to a cleaning room to be cleaned and readied for shipment.

The sand must have high permeability and good packing characteristics. This seemingly antagonistic set of objectives for the sand must be attained. Sand must not only be compacted to a degree sufficient to withstand the forces of the hot molten metal poured thereinto, assisted by the pattern gases, but must also be able to satisfactorily permit the migration of the newly generated gases from the evaporated pattern through the mold and out through the flask. Thus, the sand mold must have the proper amount of channels therein to facilitate this migration of gases.

Vibration of the flask or sand is an essential part of ECP. If vibration is not sufficient, the internal passages and voids of the foam pattern will not be filled properly and as a result the sand may cave in before the molten metal has a chance to fill the void left by the evaporated foam pattern. On the other hand, if vibration is excessive, the compactness of the sand will reduce the permeability of the mold and block the gases generated by the foam evaporation escaping through the sand to atmosphere. Too much vibration may also distort the pattern or even break the delicate foam pattern at certain locations.

How to control and measure the sand compaction level during vibration, particularly in real time, is the purpose of this invention.

Sand compactability of a mold body has been heretofore determined usually by destructive techniques (see U.S. Pat. Nos. 3,608,357; 4,555,934; 4,671,100; and 3,638,478).

Compactability in the industry has been traditionally measured by taking a sample of sand either before or after preparation of the molding. Generally, a prepared sample is taken somewhere between the mixer and the molding machine. The sample is screened or fluffed into a standard cylinder and raked level on the top. The sand is then rammed three times with a two kilogram weight. The percent compactability is computed by measuring the travel of the ram. Such measurement is actually taking a ratio of noncompacted volume to the compacted volume. However, for a given amount of material, the percentage change in volume will usually be equal to the percentage change in density. Compactability, which usually is between 30–55% for most foundry operations, is a measure of how much the sand can be compacted during the molding process. Compactability may be expressed as a ratio of the difference between the compacted sand density and the noncompacted sand density to the compacted said density.

The prior art has also used numerous other techniques for measuring other physical characteristics of the sand, which characteristics will hopefully tell how to predict compactability of the sand. Such characteristics have included sand chemistry, its grain size or shape, and moisture. These techniques are disclosed in U.S. Pat. Nos. 2,679,317; 2,890,347; 3,136,010; 3,460,030; 3,534,260; 3,693,079; and 3,600,574. However, even if all such other physical characteristics were measured for the sand being transferred to the mold, such information cannot and will not tell the operator the actual compaction of a specific mold, much less its entire, total compactability. To do so would require determining all the random distributions and locations of the grains in their locked network, not by an arbitrary selection of one location in the entire mold.

SUMMARY OF THE INVENTION

The invention is a method of controlling compactability and permeability of a sand mold containing an evaporative foam pattern during the act of mold fabrication in real time. The method comprises: (a) while agitating a supply of loose, unbonded sand introduced about such pattern suspended in a flask, supplying a pressurized gas to one station of the sand while permitting the gas to exit from another station of such sand supply; and (b) proportionally measuring the pressure differential between such stations thereby rendering a proportional indicator of sand compaction and permeability.

The agitation is preferably carried out in stages, the first stage of which comprises agitation by vibration at a rate to migrate the loose sand grains into the interior voids of the pattern, and a second stage in which the vibration is carried out at a rate until the relationship $P_2=kP_1$ is satisfied, where $P_1$ is supply pressure, $P_2$ is back pressure of the gas attempting to migrate through the sand, and where k is a factor dependent on sand chemistry, shape, and moisture and is always less than one.

Advantageously, agitation is effective to vary the exit station back pressure and is terminated when the equation $P_2=kP_1$ is satisfied. Preferably, $P_1$ is a pressure in the range of 5–15 psi and $P_2$ will be approximately $\frac{1}{2}$ to $\frac{1}{3}$ of $P_1$ when the equation $P_2=kP_1$ is satisfied.

SUMMARY OF THE DRAWINGS

FIG. 6 is a graphical illustration plotting $P_2$ as a function of $P_1$ for various conditions of K.

DETAILED DESCRIPTION AND BEST MODE

The determination of permeability while fabricating a loose sand mold is of high importance. The angle of repose of such free-flowing sand is usually around 35°, and when compacted it can reach 45° or higher. This angle of repose affects, to a great extent, the ability of the molding medium to fill in the internal cavities or voids without manual intervention. The large angle of repose prevents the sand material from behaving like a liquid to generate essentially a uniform pressure in all areas of the interface between the pattern and sand. As a result, in some areas of the pattern/sand interface, sufficient pressures will not be developed against the pattern to keep the sand in place when the molten metal enters the mold to evaporate the pattern, thereby causing imperfect castings. In addition, there is shrinkage of the sand volume as a result of compaction. Such volume can be reduced by as much as 20%. This again hinders some of the ability of the sand to properly fill in the inner cavities of the pattern. It is also important to avoid deformation of the flexible foam pattern as a result of shrinkage and random grain structure.

Agitation is an essential aspect of this invention to compact the free-flowing, dry, unbonded sand. Vibration reduces the angle of repose of the saned to act more like a liquid and flow laterally or horizontally to fill in the pattern voids. Some method must be provided to indicate the total compactability and permeability of the entire sand body within the flask, and to do so during the act of vibration or compaction so that the degree of permeability, resulting from the distribution and location of the sand grains throughout the entire sand supply as they are locked in their network by vibration, can be determined and the vibration stopped before the permeability is changed.

To this end, the method comprises controlling the permeability and compactability of the mold containing an evaporative foam pattern by the following steps: (a) while agitating a supply of loose, unbonded sand introduced about such foam pattern while the pattern is suspended in the flask, applying a pressurized gas to one station of the supply which permits the gas to exit from another station of such supply; and (b) proportionally measuring the pressure differential between such stations thereby rendering a proportional indicator of sand permeability allowing the operator to stop the agitation when the permeability has achieved a desired level.

Figure 1:
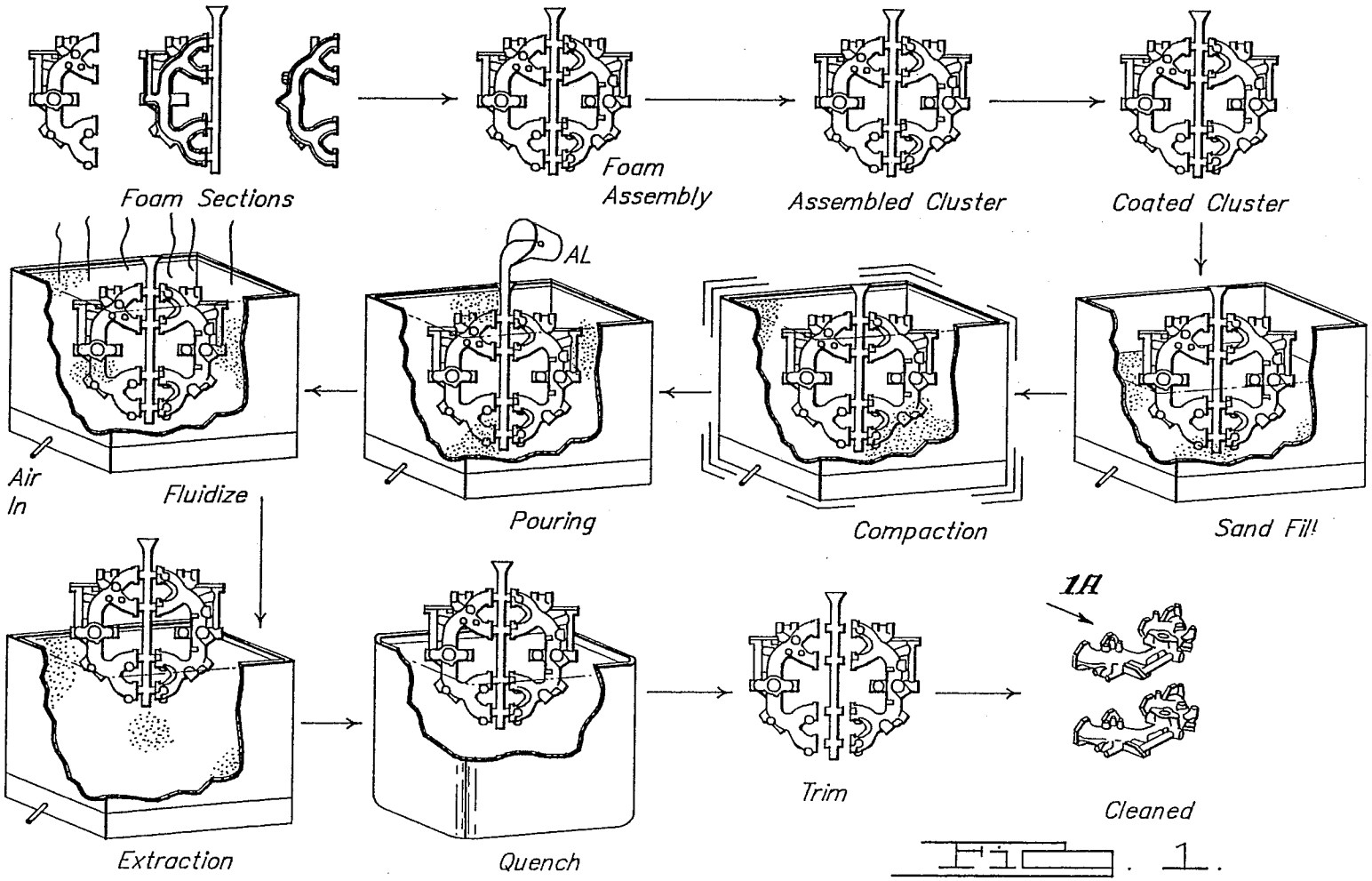
FIG. 1 is a schematic flow diagram of steps in the process of carrying out ECP according to the prior art.
Figure 1A:
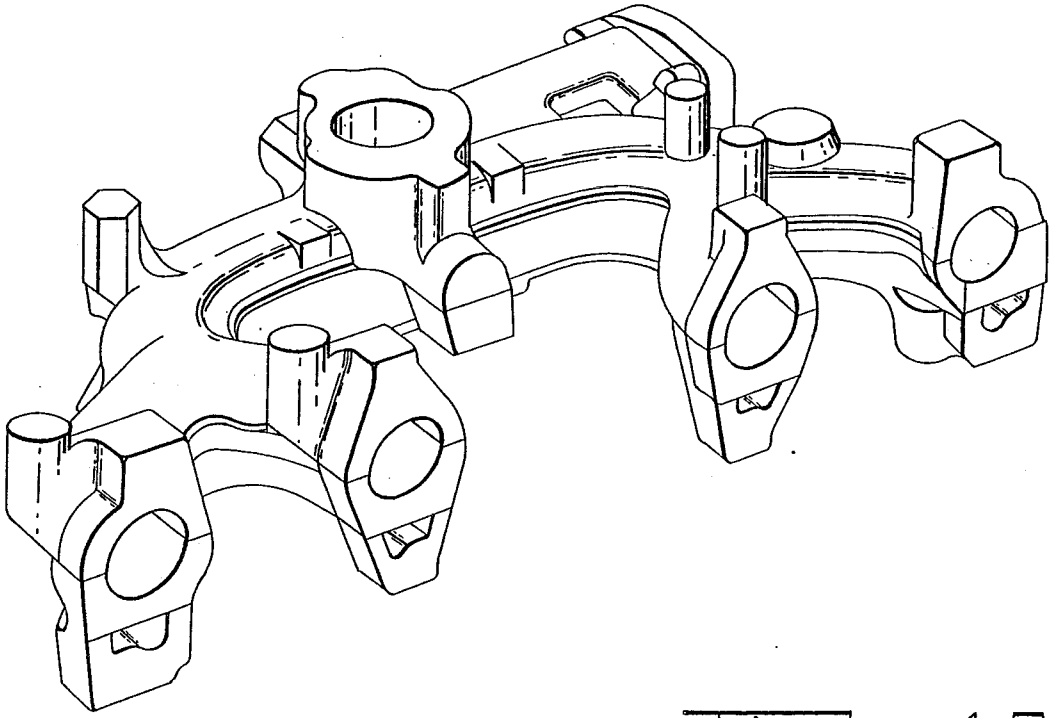
FIG. 1A is an enlarged view of one of the patterns reoriented to illustrate the internal voids that must be filled within the pattern.
Figure 2:
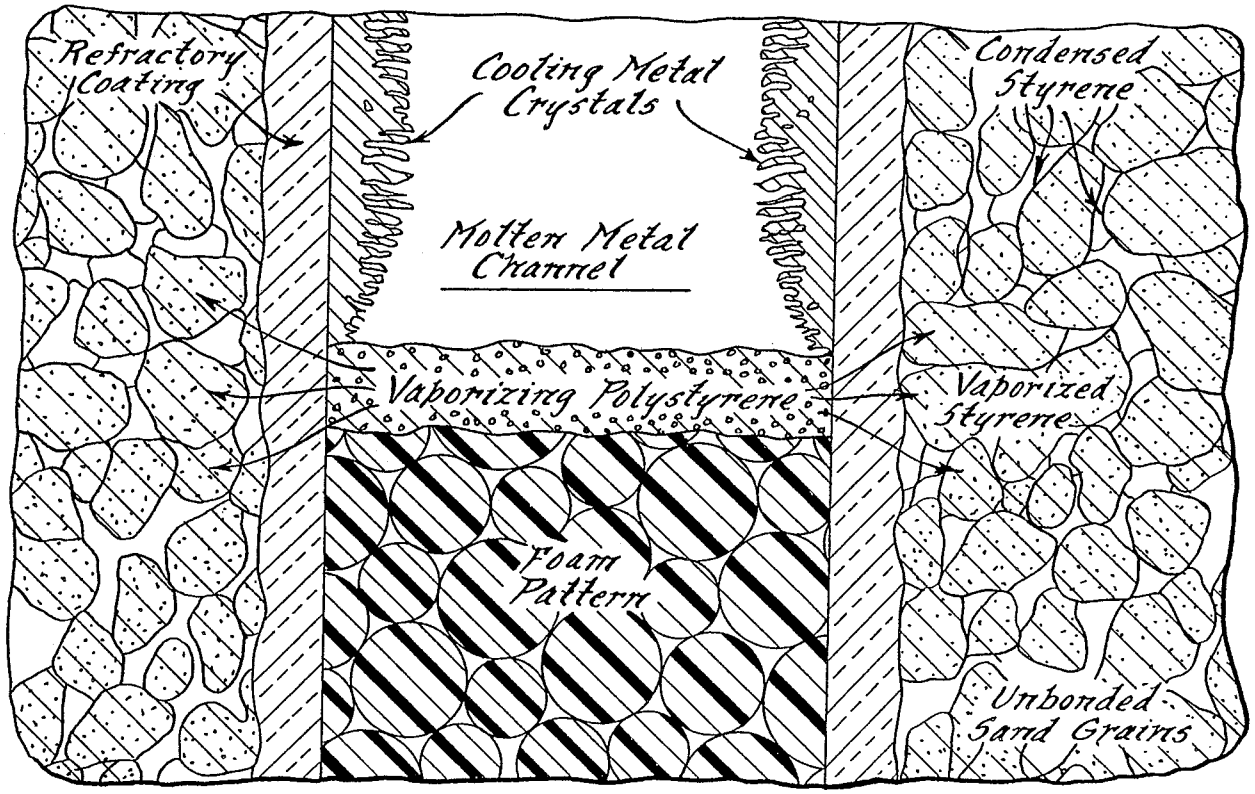
FIG. 2 is a greatly enlarged schematic illustration of a small section of the mold and foam wall illustrating the manner in which gas is evaporated upon destruction of the foam pattern by the molten metal.
Figure 3:
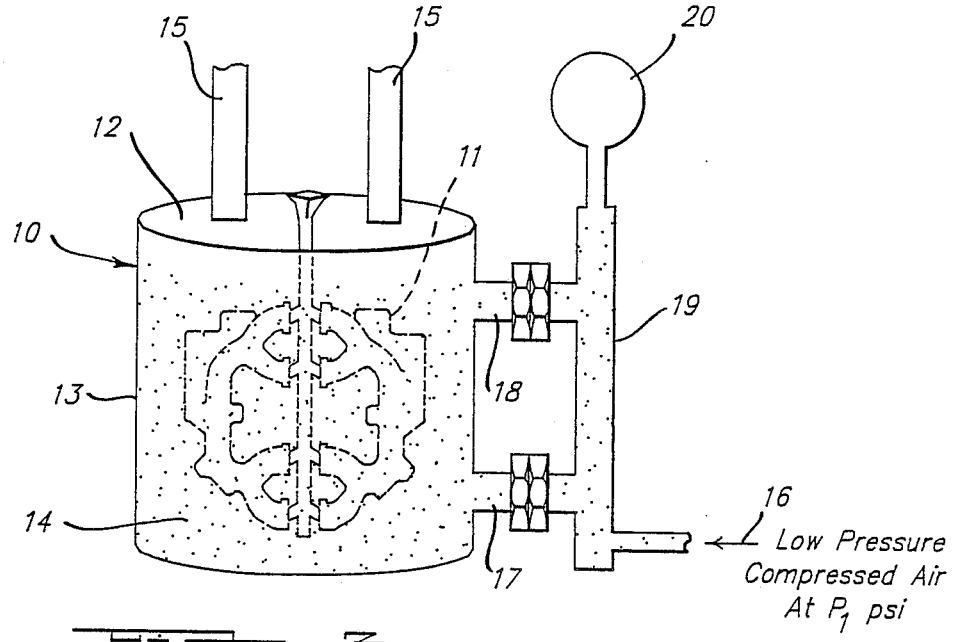
FIG. 3 is a schematic illustration of apparatus that permits the carrying out of ECP as well as determining the permeability and compactability of the unbonded sand while vibrating the sand in accordance with this invention.
Figure 5:
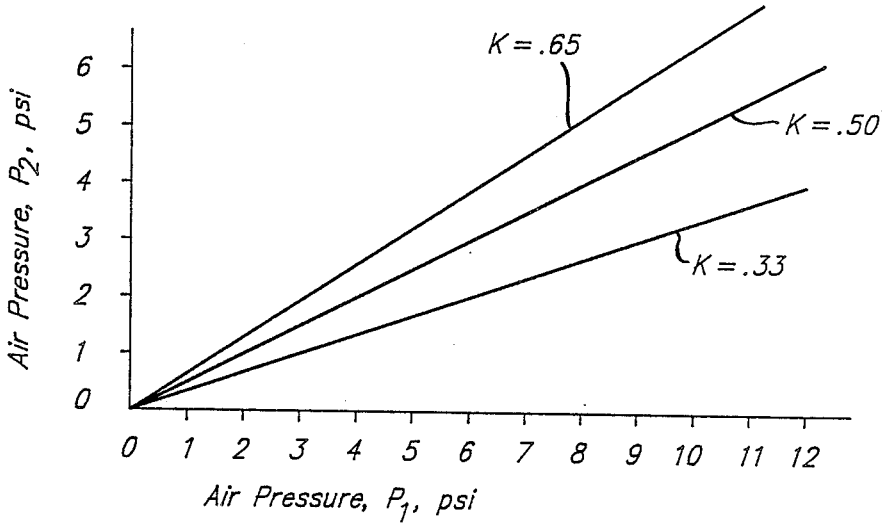
FIG. 5 is still another perspective view of another type of foam pattern for a cylinder block having siamesed voids around each of the cylinders (serving as a water jacket) for cooling an engine block and that must be filled with sand.
Figure 4:
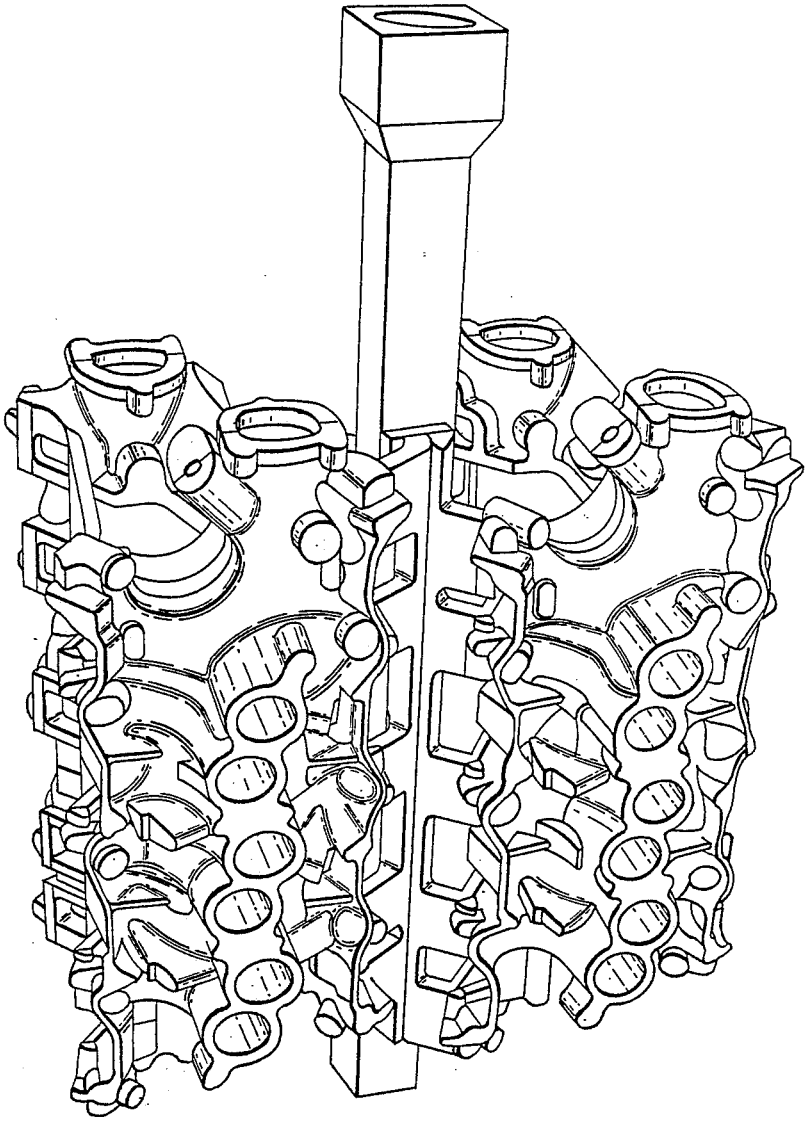
FIG. 4 is an illustration in perspective view of a cluster of foam patterns for casting engine heads, such illustration showing the complexity of internal voids that must be accommodated by the sand compaction process.
Figure 5:
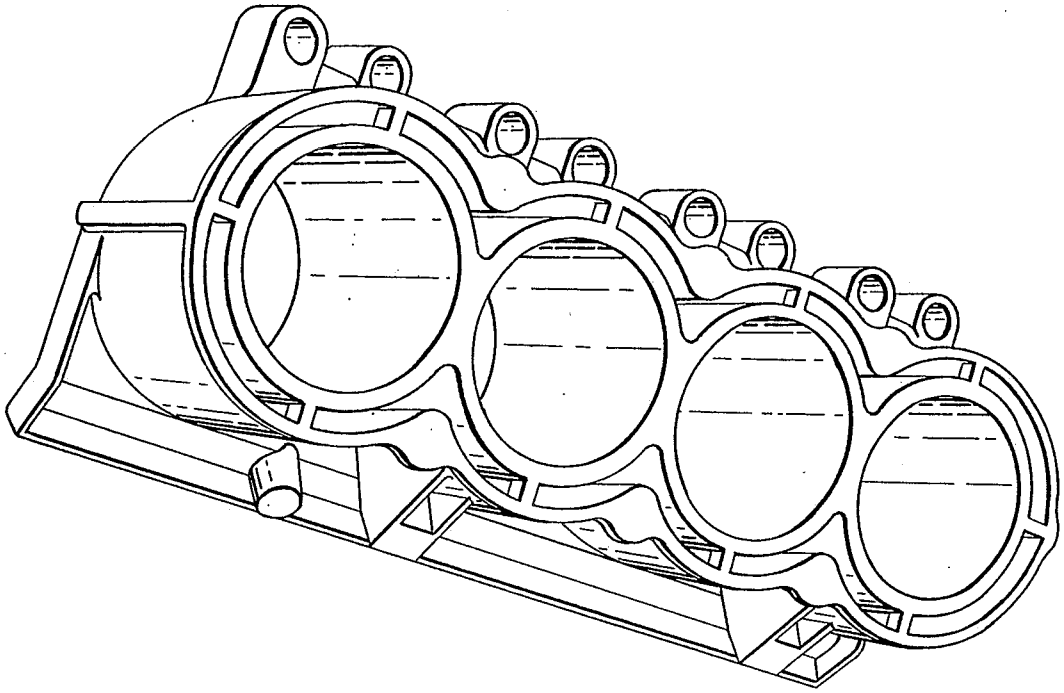

As shown in FIG. 3, the flask 10 within which a polystyrene or foam-type evaporative pattern cluster is suspended; the flask has an open top 12 as well as perforated side walls 13. The perforations are of a sufficiently small nature to prevent the passage sand therethrough. With the suspended cluster 11 in place within the interior volume of the flask, free-flowing, unbonded sand 14 is introduced to the interior of the flask through a plurality of nozzles 15, which nozzles may telescopically extend into the interior of the flask and be progressively withdrawn as the sand level rises within the flask. Alternatively, the sand may be introduced to the interior volume through a reciprocating screen (not shown) that produces a sand fall throughout the entire cross-sectional area of the flask. When particularly complex patterns are employed with interior channels that must be filled with sand, entrances to such channels should be oriented between horizontal and upright so that the channels may be filled by sideways migration of the sand or by being filled by the sand as it is dropped from above.

Vibration for the flask can be carried out by any suitable mechanism that can be attached, preferably to a pedestal on which the flask sits. The mechanism may be a plurality of motors, each of which has driven shafts which are unbalanced by eccentric weights. The speed of the motor will determine the degree of vibration. Preferably, the motors are driven at a rate of 1200–3000 rpm. Agitation for initial migration can also be obtained by use of gas or air injection through the bottom of the flask which results in a fluffing and rearrangement of the sand grains.

To measure the permeability and compactability of the sand as it is being vibrated during real time sand molding, a source of gas pressure 16, such as low pressure compressed air $P_1$, is introduced to the sand body, preferably at a station 17 adjacent the bottom thereof, and also at a station 18 adjacent the top of the sand body. A manifold 19 may be used to connect the stations 17 and 18. A gas pressure gauge 20 is placed at the manifold which measures the back pressure $P_2$ of the gas introduced at 17 and 18. Knowing the source pressure $P_1$ and measuring the back pressure of the manifold $P_2$, the differential becomes a proportional indicator of the degree of permeability of the sand body. The back pressure is proportional to the degree gas can migrate and flow through the sand supply and outward through the top of the flask or through the side wall perforations.

The agitation, preferably by vibration, can be carried out in stages, the first stage at an amplitude to migrate the loose, unbonded, free-flowing sand into the interior voids of the pattern to be filled. The required vibration amplitude and period to achieve this will depend to a large extent on the physical characteristics of the sand itself as well as the characteristics of the internal voids. Such sand characteristics include chemical content, sand grain size and distribution, and moisture content, as will be discussed.

As a second stage of such agitation, the vibration must be effective to interlock the sand grains into place having filled the interior voids, and to do so to a level of permeability that satisfies the relationship $P_2=KP_1$ where K is (i) a factor dependent on the sand chemistry, shape, moisture, and (ii) is always less than one. Having selected K properly, according to prior analysis work for the particular sand used, such as exemplified in FIG. 6, a determination can be made when $P_2$ satisfies the equation. When $P_2$ does satisfy the equation, the desired amount of permeability has been achieved and vibration is stopped.

In most cases, $P_1$ should be selected to have a pressure in the range of 5–15 psi. If the pressure exceeds 15 psi, there is a risk that the pattern might be disturbed or distorted by undue movement of the sand grains. If $P_1$ is less than 5 psi, it may result in an insufficient indicator of permeability. It has been the experience of the inventor that when $P_2$ is approximately $\frac{1}{2}$ to $\frac{1}{3}$ that of $P_1$, the sand supply will generally be adequately compacted to achieve a desirable permeability.

Sand Characteristics

The free-flowing, unbonded sand used for ECP may be washed white silica sand or a slightly less pure, tan-colored sand containing a small percentage of clay. The chemical composition of typical sands is that shown in Table I. Generally, the pure silica sand will contain 99.8% or above of $SiO_2$. In such washed silica sand, titanium dioxide, aluminum oxide, and some iron will occupy the remainder of the chemical content. In bank sand, aluminum oxide and iron oxide will be present in an amount of over 6%, along with some calcium oxide and magnesium oxide. In lake sands, a lesser amount of aluminum oxide and iron oxide will be present, along with some calcium oxide, alkali, and some magnesium oxide. Grain size is usually given as an average fineness number from sieve analysis.

Particle size distribution are properties of the basic sand and can be determined from a sieve analysis. The sieve analysis of a typical silica sand is shown in Table II according to the standard methods of sieve analysis of the American Foundry Society. The average fineness number (AFS No.) is calculated from the sieve analysis, and in this case is 66.7. A dried, 50 gram sample is used. The sample is placed on top of a series of sieves and shaken for 15 minutes. The sieve numbers and size of openings are given in Table III. After the shaking period, the sand retained on each sieve in the bottom pan is weighed and its percentage of the total sample is determined. There are three major fractions of sieve analysis to be considered: the bulk, the coarse, and the fine fractions. The bulk fraction is that percentage of the sand grains represented by the middle portion of the curves. The sand may be defined by the number of screens over which the bulk fraction is spread. The screen fraction is arbitrarily defined as one with more than 10% retained on the screen. Normally, the bulk fraction provides the major portion of the molding sand and normally constitutes more than 80% of the aggregate by weight. The total coarse fraction must be limited in an amount usually to less than 4% since an excess amount of this will contribute to a poor casting surface finish. The fine fraction of the sieve analysis will usually be in amounts of less than 10%. The fines must be limited in an amount usually to less than 5% so as not to detrimentally affect permeability. Coarse sands will provide greater void space and therefore provide for greater permeability. Thus, the average grain size and the grain size distribution will have a pronounced effect upon permeability. To achieve a desired permeability will depend in part upon the starting grain size characteristic of the sand supply.

Sand grains can have a natural shape which varies from semi-rounded to angular and even more to a subangular sand grain shape. In many cases, when sand is recycled through the molding operation, the molding sand will be a compound of all the various types of shapes depending on the ratio of new sand to used sand. The moisture content of the sand will be that of the moisture content of the surrounding air, but can be deemed for purposes herein.

While particular embodiments of the invention have been illustrated and described, it will be obvious to those skilled in the art that various changes and modifications may be made without departing from the invention, and it is intended to cover in the appended claims all such modifications and equivalents as fall within the true spirit and scope of the invention.

TABLE I

| Constituents | Washed silica sand* | Washed and dried silica | Typical bank sand | Western bentonite bonded silica sand§ New | Western bentonite bonded silica sand§ Used | Typical lake sand |
|---|---|---|---|---|---|---|
| Loss on ignition, % | — | — | 1.02 | 0.28 | 0.12 | 0.80 |
| C, % | — | — | — | 0.13 | 0.59 | |
| Free iron, % | — | — | — | — | 0.97 | |
| Ferrous iron, % | — | — | — | 0.44 | 0.68 | |
| Ferric iron, % | — | — | — | 0.00 | 0.12 | |
| Total iron, % | 0.10 | — | — | 0.44 | 1.77 | |
| $Al_2O_3$, % | 0.39 | — | — | 1.32 | 0.63 | |
| $SiO_2$, % | 99.08 | 99.80+ | 92.09 | 95.79 | 95.54 | 95.0+ |
| $TiO_2$, % | 0.43 | | | | | |
| Total $Al_2O_3$ + $Fe_2O_3$, % | — | — | 6.09 | — | — | 2.0 |
| CaO, % | — | — | 0.58 | — | — | 0.60 |

TABLE I-continued

| Constituents | Washed silica sand* | Washed and dried silica | Typical bank sand | Western bentonite bonded silica sand§ New | Western bentonite bonded silica sand§ Used | Typical lake sand |
|---|---|---|---|---|---|---|
| Alkali, % | — | — | — | — | — | 0.20 |
| MgO, % | — | — | 0.22 | — | — | 0.40 |

TABLE II

| U.S. Series equivalent No. sieve | Amounts of 50-g sample retained on sieve Grams | Percent | Multiplier | Product |
|---|---|---|---|---|
| 6 | — | — | 3 | |
| 12 | — | — | 5 | |
| 20 | — | — | 10 | |
| 30 | — | — | 20 | |
| 40 | 0.7 | 1.4 | 30 | 42.0 |
| 50 | 7.7 | 15.4 | 40 | 616.0 |
| 70 | 17.85 | 35.7 | 50 | 1785.0 |
| 100 | 14.2 | 28.4 | 70 | 1988.0 |
| 140 | 7.4 | 14.8 | 100 | 1480.0 |
| 200 | 1.65 | 3.3 | 145 | 462.0 |
| 270 | — | — | 200 | |
| Pan | 0.5 | 1.0 | 300 | 300.0 |
| Total | 50.0 | 100.0 | — | 6673.0 |

$$\text{AFS No.} = \frac{\text{total product}}{\text{total percent retained}} = \frac{6673}{100} = 66.73$$

TABLE III

| U.S. Series equivalent No. | Tyler screen scale sieves, meshes per lin in. | Openings, mm | Openings, in., ratio $\sqrt{2}$, or 1.414 | Permissible variations in avg opening % ± | Diam wire, decimal of an in. | Mesh openings, microns |
|---|---|---|---|---|---|---|
| 4 | 4 | 4.699 | 0.187 | 3 | 0.065 | 4760 |
| 6 | 6 | 3.327 | 0.132 | 3 | 0.036 | 3327 |
| 8 | 8 | 2.362 | 0.0937 | 3 | 0.035 | 2362 |
| 12 | 10 | 1.651 | 0.0661 | 3 | 0.032 | 1651 |
| 16 | 14 | 1.167 | 0.0469 | 3 | 0.025 | 1167 |
| 20 | 20 | 0.833 | 0.0331 | 5 | 0.0172 | 833 |
| 30 | 28 | 0.589 | 0.0232 | 5 | 0.0125 | 589 |
| 40 | 35 | 0.414 | 0.0165 | 5 | 0.0122 | 414 |
| 50 | 48 | 0.295 | 0.0117 | 5 | 0.0092 | 295 |
| 70 | 65 | 0.208 | 0.0083 | 5 | 0.0072 | 208 |
| 100 | 100 | 0.147 | 0.0059 | 6 | 0.0042 | 147 |
| 140 | 150 | 0.104 | 0.0041 | 6 | 0.0026 | 104 |
| 200 | 200 | 0.074 | 0.0029 | 7 | 0.0021 | 74 |
| 270 | 270 | 0.053 | 0.0021 | 7 | 0.0016 | 53 |

What is claimed:

1. A method of controlling compactability and permeability of a mold containing an evaporative foam pattern, comprising:

(a) while agitating a supply of loose, unbonded sand introduced about said pattern while said pattern is suspended in a flask, applying a pressurized gas to at least one station of said sand supply while permitting said gas to exit from another station; and (b) proportionally measuring the pressure differential between such stations thereby rendering a proportional indicator of sand permeability.

2. The method as in claim 1, in which agitation is carried out to vary the pressure $P_2$ at said another station to satisfy the equation $P_2=kP_1$ where k (i) is a factor dependent on sand chemistry, shape, and moisture, and (ii) is always less than one.

3. The method as in claim 2, in which agitation is carried out in stages, the first stage being one in which the agitation is at an amplitude to migrate the losse, free-flowing sand grains into all the interior voids of said pattern, and a second stage in which agitation continues until the relationship $P_2=kP_1$ is satisfied, where $P_1$ is supply pressure and $P_2$ is back pressure.

4. The method as in claim 1, in which $P_1$ is in the range of 5–15 psi.

5. The method as in claim 1, in which the sand characteristics as comprised of (a) a moisture content which is essentially dry, (b) a sand grain shape which predominantly is comprised of semi-rounds, and (c) a sand chemistry content having greater than 99.8% $SiO_2$.

6. The method as in claim 1, in which said pattern is comprised of expanded bead polystyrene.

7. The method as in claim 3, in which a plurality of stations are employed to permit the introduction of said gas pressure to said flask, one inlet station being at the base of the flask and another inlet station being at the top of the sand supply and are interconnected by a common manifold, $P_2$ being measured within said manifold.

8. The method as in claim 3, in which $P_2$ is generally in the range of $\frac{1}{2}$ to $\frac{1}{3}$ that of $P_1$.

9. The method as in claim 1, in which said agitation and measurement is carried out in real time while said mold is being formed.

10. A method to control fabrication of an ECP mold comprising:

(a) suspending a polystyrene foam cluster of patterns within the interior of a flask with internal voids of such patterns having their entrances directed between zero and 90° of a horizontal;

(b) introducing sand into said flask about said suspended cluster while changing the density of said sand mass through mechanical means;

(c) vibrating said flask to compact and densify said free-flowing sand body around the suspended foam pattern;

(d) passing a gas through said sand body at a constant source pressure and measuring the back pressure of said gas at a plurality of stations along the height of said sand supply, the difference between said measured pressure and the source pressure rendering an indicator of the degree of compactness of said sand body; and (e) ceasing vibration when said back pressure reaches a certain level and noting the period it took for vibration to achieve such permeability.

11. The method as in claim 1, in which in step (d) the source pressure is $P_1$, and the back pressure is $P_2$, said vibration in step (e) is stopped when $P_2=kP_1$, where k is a factor dependent on sand chemistry, shape and moisture, and is always less than one.

* * * * *